United States Patent [19]

Schmidt

[11] 4,200,113

[45] Apr. 29, 1980

[54] LIPID REMOVAL FROM TOBACCO

[75] Inventor: Otto K. Schmidt, South Windsor, Conn.

[73] Assignee: AMF Incorporated, White Plains, N.Y.

[21] Appl. No.: 795,989

[22] Filed: May 11, 1977

Related U.S. Application Data

[63] Continuation-in-part of Ser. No. 588,272, Jul. 19, 1975, abandoned.

[51] Int. Cl.[2] ..... A24B 15/04; A24B 15/08

[52] U.S. Cl. ..... 131/17; 131/145

[58] Field of Search ..... 131/140 R, 140 B, 17 R, 131/142 R, 142 A, 143, 144; 260/291; 546/282

[56] References Cited

U.S. PATENT DOCUMENTS

| | | | |
|---|---|---|---|
| 2,048,624 | 7/1936 | Roselius | 131/143 |
| 2,822,306 | 2/1958 | Beuel et al. | 131/143 |
| 3,323,524 | 6/1967 | Shamberger | 131/143 |

FOREIGN PATENT DOCUMENTS

| | | | |
|---|---|---|---|
| 24114 | 1/1883 | Fed. Rep. of Germany | 131/143 |
| 949151 | 9/1956 | Fed. Rep. of Germany | 131/143 |
| 400885 | 4/1966 | Switzerland | 131/143 |
| 17037 | of 1912 | United Kingdom | 131/143 |
| 991503 | 11/1971 | United Kingdom | 131/143 |
| 993077 | 2/1972 | United Kingdom | 131/143 |

OTHER PUBLICATIONS

*Tobacco and Tobacco Smoke,* Wynder et al., Published by Academic Press, N.Y., N.Y., and London, 1967, pp. 125–127, and pp. 198–202.

Oncologia., vol. 13, No. 2, 1960, pp. 271–278, author Mouran et al., Title: Extraction of Tob., by Some Org. Solu. and Conseq. on Chem. Comp. of Smoke.

South African Publication of Patent, Application No. 72/3935, date of publication 6/8/72, Gewe.

*Primary Examiner*—V. Millin

*Attorney, Agent, or Firm*—George W. Price; Charles J. Worth

[57] ABSTRACT

This invention concerns a method of extracting lipids from tobacco by use of water and water-miscible organic solvents, preferably lower alkanols, while substantially retaining residual structural characteristics and organoleptic properties in smoking.

11 Claims, No Drawings

LIPID REMOVAL FROM TOBACCO

REFERENCE TO RELATED APPLICATIONS

This application is a continuation-in-part of copending application Ser. No. 588,272 filed July 19, 1975 now abandoned.

BACKGROUND OF THE INVENTION

Elements of the tobacco plant are known to comprise a proportion of lipids, a component of varying composition, variously defined but most commonly referenced for convenience as included within the hydrocarbon solvent extractables, e.g. from petroleum ether or hexane.

Recently lipids have occassioned interest in the continuing analysis of health related aspects of the use of tobacco. Specifically, it has been suggested that the hydrocarbon solvent solubles contribute to the generation of polynuclear aromatic hydrocarbons during leaf pyrolysis. Experimental results demonstrate that about 70% of the aromatic hydrocarbons, ranging from benzene to benz(α)pyrene in the pyrolysates are due to leaf components extractable with hexane and acetone, although these extracts amount to less than 25% of dry leaf weight. See "Studies on the Pyrogenesis of Tobacco Smoke Constituents: A Review" Chortyk, O. T. and Schlotzhauer, W. S. Beitrage zur Tabakforschung (Vol. 7, #3 Nov. 1973, pp. 165–177).

There are numbers of lipid fractions characterized by the extraction technique employed. The neutral lipids (commonly defined by high solubility in chloroform) form the major portion of tobacco leaf lipid material, comprising about 60–75% of the total. Accordingly, the most common lipid extraction techniques are based upon chloroform. Other solvent extraction methods are intended principally to remove tobacco solubles and nicotines. In either case, solvent extraction inevitably removes additional chemical constituents, often those which contribute favorably to taste and aroma. Accordingly, methods are desirably identified for selective treatment of tobacco to minimize the lipid fraction while retaining the physical and chemical integrity of the remaining components.

The neutral lipids which may be observed on tobacco leaf surfaces and are generally associated with the glandular trichomes (hairs) which cover the leaf surface and the cuticle layer just beneath these hairs, may be removed by mechanical techniques, as more fully disclosed in copending and commonly assigned application Ser. No. 556,025, filed Mar. 6, 1975 now U.S. Pat. No. 4,018,234.

The internal lipids are generally of somewhat different composition, and may be differentiated into further fractions believed to interrelate with composition.

Some efforts have been made to isolate such fractions in the handling of defatted soybean flakes, and certain solvent treatments are reported to improve color and flavor and to modify the properties of soy proteins. See *AIChE Symposium Series:Food Preservation,* Vol. 69, (1973) No. 132 pp. 5–9, and references cited. However, odor and flavor observations developed by direct application of food compositions to the tongue or palate are not comparable to the smoking experience involving a complex of aesthetic and olfactory responses to the spectrum of individual components developed in mainstream and sidestream smoke in the course of pyrolysis, pyrosynthesis and distillation.

Indeed, the difficulty with selective tobacco extraction may be traceable to the multiplicity of components involved: an extensive composition study on the hexane soluble material of flue-cured leaves (*Chemistry and Industry,* Vol. 14 1961 pp. 435–6) concluded that the bulk of the constituents could not be fractionated despite intensive effort.

Most importantly, little correlation is available to individually interrelate smokestream components to original tobacco treatment steps, ranging from chloroform or petroleum ether treatments to water washes, bleaches or even the complete extraction reported with a sequence of 95% ethanol, alcoholbenzene, 1% HCl, 5% sulfuric acid and water. Moreover, many such extraction processes are disclosed only for analytic purposes, and remove components exhaustively which are necessary to satisfactory taste in smoking.

Co-pending and commonly assigned application Ser. No. 556,080, Filed Mar. 6, 1975 now U.S. Pat. No. 4,144,895 describes the utilization of a particularized solvent extraction technique providing a substantial reduction in tobacco lipids including so-called bound internal lipids with minimized loss of solubles including nicotine and taste and aroma constituents. This result is found to ensue despite the use of a polar solvent component known to be especially effective in the removal of nicotine and tobacco solubles.

U.S. Pat. No. 2,822,306 describes the extraction of nicotine from tobacco with organic solvents containing limited amounts of water, the function of the water being for the purpose of substantially avoiding the co-extraction of oils, waxes, and resin, and at the same time favoring the removal of nicotine.

Mouron et al., in "Extraction of Tobacco by some Organic Solvents and Consequences on Chemical Composition of the Smoke" *Oncologia* 13, No. 2 (1960) pp. 128–135 refers to tobacco extractions with ethanol, in which system water does not exceed five percent, as being a bad solvent, and emphasizes halogenated hydrocarbon solvents in other testing of humidified tobacco.

BRIEF DESCRIPTION OF THE INVENTION

It has now been found that the utilization of particular solvent extraction techniques with water and water-soluble organic solvents results in substantial reduction in tobacco lipids including so-called internal lipids. This is indeed surprising in view of the generally accepted view that lipid extraction requires solvents that are commonly water-insoluble.

The present invention is concerned with a process for reducing the lipid content of tobacco by contacting the tobacco with water and a water-soluble, i.e., miscible, organic solvent. By use of the present invention, the lipid content of the so treated tobacco is reduced substantially, the results obtained being comparable to the reduction of lipid content realized with organic non-polar/polar solvent systems described in the aforementioned copending application Ser. No. 556,080 now U.S. Pat. No. 4,144,895. Advantageously, the use of the water-soluble organic solvents of the present invention, especially the preferred solvents, substantially diminishes the hazards of employing the prior art solvents which commonly include highly volatile, flammable liquids such as hexane, petroleum ether and the like, the use of which always poses the danger of explosion and fire, thus necessitating special handling equipment and extreme caution.

DETAILED DESCRIPTION OF THE INVENTION

The tobacco is contacted with the extractive medium in a moistened state i.e., the effect of system water in the process is considered important to a satisfactory extraction, and is maintained at a level of at least 15 percent by volume. The organic solvent, being water soluble or water-miscible, may be utilized as the azeotrope with water, for example.

For the purpose of the present process, it is sufficient to merely contact the tobacco with the aforesaid solvent system to accomplish extraction of the lipid content. For practical reasons, which include the economy of time required, the extractive contact is maintained in the manner dictated by conditions of temperature, physical state of the tobacco, the state of the solvent system (liquid-vapor) and other factors which are familiar to those skilled in the art.

The extraction process can be effected in any of the art-recognized modes ranging from simple immersion of the tobacco in the solvent to solid-liquid counter-current extraction procedures. The extraction can be effected in batch fashion or in a continuous operation, the latter being preferred for commercial operations. Thus, the solvent system, hot or at room temperature, can be used in the liquid phase, or alternatively, in the vapor phase, as in Soxhlet extraction equipment.

Such conditions include simply prolonged exposure of the tobacco to the said liquid solvents under ambient conditions with or without agitation; exposure to the said liquids at elevated temperatures; and exposure to the vaporous solvents as in Soxhlet extraction equipment. The contact with water can be effected by mere washing of the tobacco in the water at room temperature and subsequent contact with organic solvent or by the use of mixtures of organic solvent and water, in a combined extraction. The extraction can be accomplished by way of Soxhlet extraction techniques, or alternatively by mere washing with the organic solvent system under ambient conditions. Where washing techniques are used, it is preferred to repeat washings two or three times with smaller volumes of the extractive liquid rather than a single washing with a large volume of liquid, as is dictated by good laboratory technique. The period of washing with the solvent, water and/or organic solvent, should be at least about 0.25 hour, preferably in excess of 0.5 hour, and up to about 1.5 hours.

It has been found that the lipid extraction efficiency can be increased when the wash water, whether used separately from the solvent or in mixture with the solvent, is made alkaline. For example, when the wash water is adjusted to a pH in the range of 10–11, the lipid extraction efficiency increases substantially as evidenced by determination of the residual lipid in the extracted tobacco i.e., less than 2% for water at pH=10.5 vs 3.0% for distilled water at a pH of about 7.0 in the two step extraction procedure using 80% aqueous isopropanol. The use of any alkaline pH, i.e., above pH=7 improves extraction efficiency, but it is preferred to employ pH values above about 9 and preferably between about 9 and about 11 for best results. The adjustment of pH can be accomplished by use of any of the usual alkaline agents commonly employed for this purpose, including various soluble metal hydroxides, such as sodium or potassium hydroxides, or ammonium hydroxide, or alkaline salts such as trisodium phosphate. The selection of alkaline agent is usually one of convenience and is dictated solely by laboratory practice. For most purposes, including convenience ammonium hydroxide or sodium hydroxide are preferred.

To facilitate washing with water, it is convenient to use surfactants, e.g., sorbitan monoesters and polyoxyalkylated derivatives thereof, such as sorbitan monostearate (Span) or the polyoxyethylated derivatives thereof (Tween); or quaternary salts, such as cetylpyridinium halide.

Usually, the water-organic solvent ratio should be not greater than 1:1 (V/V) and preferably the mixture should contain from about 15% to about 30% by volume water calculated on the basis of system water i.e. retained moisture in the tobacco and the water content of the organic solvent.

The water-soluble organic solvents for use in the present invention include alcohols, ketones, such as acetone, dimethylformamide, dimethylsulfoxide, tetrahydrofuran, dioxane and similar such organic solvents commonly employed in the laboratory. Up to the present ime, the alcohols are preferred since they appear to provide the best overall results and efficiencies. The most preferred of the alcohols are the lower alkanols which are readily miscible with water.

The lower alkanols preferred for the present solvent system include methanol, ethanol, propanol, isopropanol and 3°-butanol, all of which are miscible with water in all proportions. Of these, ethanol and isopropanol are preferred for economic reasons coupled with the relative ease of removal at reduced pressure and/or moderate temperatures.

The tobacco is preferably in highly comminuted form to reduce the time requirement for extraction. Thus, the tobacco may be comminuted to fine mesh size, e.g., 20 to 100 mesh and even higher, to increase the extraction efficiency. Alternatively, large particle size and even leaf tobacco may be used but the extractive process time requirements are prolonged accordingly. The advantages in higher efficiency in lipid removal and shorter contact periods makes the highly comminuted form preferred, particularly since the comminuted form can be readily cast into tobacco sheet by admixture with suitable adhesives and binding agents by methods well-known in the art of reconstituting tobacco.

When tobacco is treated in accordance with the present process, the use of water and alcohol does deplete the solids content of the tobacco resulting in overall weight losses due to removal of the water and alcohol solubles other than lipids. This weight loss can be minimized to an appreciable degree by use of the single step extraction using water-alcohol mixtures, but with slightly less lipid-removal efficiency. The weight loss can be compensated, on the other hand, by recovering the water solubles and returning the water solubles to the tobacco after the organic solvent contact step. This can be accomplished by merely returning the water solubles to the process of preparing reconstituted tobacco sheet.

In the following examples which further illustrate the invention, there are indicated various lipid determinations, either on unextracted or on extracted tobacco, which determinations are expressed on the basis of the dry weight of the sample prior to residual lipid analysis. Accordingly, no attempt was made to correct the percent lipid values reported for any change in weight that may have occurred, i.e. the change in weight of the extracted tobacco vs. the unextracted tobacco, but rather all % lipids are based on the initial dry weight of the tobacco before lipid analysis. The usual total weight loss of the unextracted tobacco is less than about 20% on extraction with the solvent systems of this invention, of which from about 70 to about 90% is lipid, as determined by solubility in chloroform, a standard art-recognized determination.

EXAMPLE I

Two samples of tobacco, 12 grams each, are extracted at room temperature for a period of one hour with each of three batch water washings of 100 ml each. After the third washing the wet tobacco is washed, and in one case, with five batch washings, 800 ml each, of water and in the other case with five batch washings, 800 ml each, of 80% isopropylalcohol (IPA). These washings are approximately one-half hour each. A third sample of tobacco, 12 grams, is extracted with five washings, 800 ml each, of 80% IPA plus 20% water. The results are listed below.

| Pre-Wash | Wash Media | % Lipids in Residue |
|---|---|---|
| None | None | 7.2 (control) |
| None | 80% IPA | 4.3 |
| Water | Water | 10.0 |
| Water | 80% IPA | 2.9 |

As can be seen for the tobacco sample which was pre-washed with water followed by washing with water-isopropylalcohol, the lipid content is 60% lower than the lipid content of the original tobacco.

EXAMPLE 2

Two samples of tobacco, 12 grams each, are extracted at room temperature, for one hour with each of three batch washings of 100 ml each of water made to pH 10.5 before the extractions are begun. After the third washing the wet tobacco is washed, in one case, with five batch washings, 800 ml each of water; in the other case with five batch washings, 800 ml each of a solvent consisting of 20% water plus 80% isopropylalcohol (IPA). These washings are approximately one-half hour each. A third sample of tobacco, 12 grams, is extracted with five washings, 800 ml each of 80% IPA plus 20% water. The results are listed below.

| Pre-Wash | Washing Media | % Lipids in Residue |
|---|---|---|
| None | None | 7.2 (control) |
| None | 80% IPA | 4.3 |
| Water (pH 10.5) | Water | 9.4 |
| Water (pH 10.5) | 80% IPA | 1.7 |

As can be seen for the tobacco sample which was pre-washed with water followed by washing with water-isopropyl-alcohol, the lipid content is 76% lower than the lipid content of the original tobacco.

EXAMPLE 3

Two samples of tobacco, 12 grams each, are extracted at room temperature, for one hour with each of three batch washings of 100 ml each of water which contains 0.1% polyoxyethylene sorbitan monolaurate (Tween 20). After the third washing the wet tobacco is washed, in one case, with five batch washings 800 ml each of water; in the other case with five batch washings, 800 ml each, of a solvent consisting of 20% water plus 80% isopropylalcohol (IPA). These washings are approximately one-half hour each. A third sample of tobacco, 12 grams, is extracted with five washings, 800 ml each, of 80% IPA plus 20% water. The results are listed below.

| Pre-Wash | Washing Media | % Lipids in Residue |
|---|---|---|
| None | None | 7.2 (control) |
| None | 80% IPA | 4.3 |
| Water (0.1% Tween 20) | Water | 10.7 |
| Water (0.1% Tween 20 | 80% IPA | 1.7 |

As can be seen for the tobacco sample which was pre-washed with water followed by washing with water-isopropylalcohol, the lipid content is 76% lower than the lipid content of the original tobacco.

EXAMPLE 4

Two samples of tobacco, 12 grams each, are extracted at room temperature for one hour with each of three batch washings of 100 ml each of water which contains 0.1% Tween 20 and is made basic with $NH_4OH$ to at least pH 10.5 before the extractions are begun. After the third washing the wet tobacco is washed, in one case, with five batch washings, 800 ml each, of a solvent consisting of 20% water plus 80% isopropylalcohol (IPA). These washings are approximately one-half hour each. A third sample of tobacco, 12 grams, is extracted with five washings, 800 ml each, of 80% IPA plus 20% water. The results are listed below.

| Pre-Wash | Washing Media | % Lipids in Residue |
|---|---|---|
| None | None | 7.2 (control) |
| None | 80% IPA | 4.3 |
| Water (pH 10.5 + 0.1% Tween 20) | Water | 10.3 |
| Water (pH 10.5 + 0.1% Tween 20) | 50% IPA | 3.0 |
| Water (pH 10.5 + 0.1% Tween 20) | 80% IPA | 2.0 |
| Water (pH 10.5 + 0.1% Tween 20) | 100% IPA | 1.5 |

As can be seen for the tobacco sample which was prewashed with water followed by washing with water-isopropylalcohol, the lipid content is 72% lower than the lipid content of the original tobacco.

EXAMPLE 5

Two samples of tobacco, 12 grams each, are extracted at room temperature, for one hour with each of three batch washings of 100 ml each of water which contains 0.1% cetylpyridinium chloride (CPC). After the third washing the wet tobacco is washed, in one case, with three batch washings, 800 ml each, of water; in the other case with three batch washings, 800 ml each, of a solvent consisting of 20% water plus 80% isopropylalcohol (IPA). These washings are approximately one-half hour each. A third sample of tobacco, 12 grams, is extracted with three washings 800 ml each of 80% IPA plus 20% water. The results are listed below.

| Pre-Wash | Washing Media | % Lipids in Residue |
|---|---|---|
| None | None | 7.2 (control) |
| None | 80% IPA | 4.3 |
| Water (CPC) | Water | 6.2 |
| Water (CPC) | 80% IPA | 1.3 |

As can be seen for the tobacco sample which was prewashed with water followed by washing with water-isopropylalcohol, the lipid content is 82% lower than the lipid content of the original tobacco.

EXAMPLE 6

Samples of tobacco, 12 grams each, are washed two or three times, as indicated in the table below, for one hour with 100 ml of the designated washing media in each washing cycle. There was no agitation applied during the washing cycle. Some of the washes were performed at room temperature some at an elevated temperature. The washing medium consisted of 20 ml of water which was made 0.15 N with base (either NaOH or $NH_4OH$) plus 80 ml of isopropylalcohol (IPA).

| | Washing System | | % Lipids |
|---|---|---|---|
| No. of Washes | Temp. of Wash | Solvent | in Residue |
| None | None | None | 7.2 Control |
| 2 | Room Temp. | $NH_4OH$-IPA | 2.8 |
| 3 | Room Temp. | $NH_4OH$-IPA | 1.6 |
| 2 | 60° C. | $NH_4OH$-IPA | 2.2 |
| 3 | 60° C. | $NH_4OH$-IPA | 1.9 |
| 2 | Room Temp. | NaOH-IPA | 2.8 |
| 3 | Room Temp. | NaOH-IPA | 2.8 |
| 2 | 60° C. | NaOH-IPA | 2.7 |
| 3 | 60° C. | NaOH-IPA | 1.4 |

As can be seen, three of these washing cycles removed approximately 80% of the lipids which were present in the starting tobacco.

EXAMPLE 7

Tobacco samples are washed at 11% solids level in a pre-wash (three washes, one hour each) and then at 5% solids level with IPA (80%)—$H_2O$(20) (three washes, ½ hour each) and the % lipid in the dried residue tobacco determined along with the nicotine levels of the dry tobacco with the following results:

| | | | Nicotine | |
|---|---|---|---|---|
| Pre-Wash | Wash | % Lipids | % Per Dry Gram (1) | % Reduction |
| 1. control | control | 7.2 | 0.81 | — |
| 2. water | IPA:$H_2O$ (80:20) | 2.9 | 0.17 | 79 |
| 3. 0.15 N $NH_4OH$ | IPA:$H_2O$ (80:20) | 1.7 | 0.20 | 75 |
| 4. 0.15 N NaOH | IPA:$H_2O$ (80:20) | 3.5 | 0.13 | 84 |

(1) Determined by steam distillation and u.v. analysis of steam distillate.

EXAMPLE 8

The procedure of Example 7 is repeated excepting the pre-wash is omitted with the following results:

| | | | Nicotine | |
|---|---|---|---|---|
| Wash | No. of Washes (1) | % Lipids | % Per Dry Gram | % Reduction |
| IPA (80%)-0.15 N $NH_4OH$ (20%) | 2 | 2.4 | 0.44 | 46 |
| IPA (80%)-0.15 N $NH_4OH$ (20%) | 3 | 2.0 | 0.36 | 56 |
| IPA (80%)-0.15 N HCl (20%) | 2 | 5.4 | 0.42 | 48 |
| IPA (80%)-0.15 N HCl (20%) | 3 | 4.5 | 0.36 | 56 |

(1) Each wash is for one hour

EXAMPLE 9

(A) A sample of tobacco containing 5.0% (determined by hexane-Soxhlet extraction) lipid is extracted in a solid-liquid counter-current extractor using as liquid phase IPA: $H_2O$ (80:20). The extracted tobacco after drying at 105° C. overnight is then Soxhlet extracted with hexane and the lipid content of the tobacco determined to be 0.5%, showing an 89% reduction in hexane-soluble lipid.

(B) An identical sample of tobacco containing 6.2% (determined by Soxhlet extraction with hexane:ethanol (80:20) azeotrope) lipid is extracted in accordance with the procedure of paragraph A and showed an 85% reduction in hexane:ethanol soluble lipid.

Substitution of methanol, ethanol or n-propanol gives comparable results.

EXAMPLE 10

The procedure of Example 7, i.e. pre-wash with water and then extract with aqueous solvent, is repeated but the washes are reversed, i.e. the water wash follows the treatment with aqueous solvent, with the following results:

| Pre-wash (1) | Wash (2) | % lipid (residue) (3) |
|---|---|---|
| $H_2O$ | $H_2O$ | 10.6 |
| IPA:$H_2O$ (80:20) | $H_2O$ | 6.6 |
| IPA:$H_2O$ (50:50) | $H_2O$ | 8.7 |
| IPA (100%) | $H_2O$ | 6.6 |

(1) at 11% solids, three washes for 1 hr. each
(2) at 5% solids, 5 washes each
(3) Soxhlet Extraction with hexane-ethanol (80:20) of dried tobacco.

From these data, the reversing of the water treatment step of Example 7 to after the aqueous solvent treatment step leads to reduced lipid removal.

EXAMPLE 11

Samples of tobacco (VBSL) are extracted for 18 hours in a Soxhlet extractor with various solvent systems with the following results:

| Solvent | Nicotine Reduction (%) (1) | (%) Extracted (1) | % of extract solids soluble in $CHCl_3$ (2) | % lipid in extract (3) |
|---|---|---|---|---|
| Hexane | 33 | 4.1 | 100% | 4.1 |
| IPA | 72 | 18.5 | 20% | 3.7 |
| Hexane-IPA (azeotrope) | 32 | 6.3 | 80% | 5.0 |

-continued

| Solvent | Nicotine Reduction (%) (1) | (%) Extracted (1) | % of extract solids soluble in $CHCl_3$ (2) | % lipid in extract (3) |
|---|---|---|---|---|
| $CHCl_3$ | 34 | 5.8 | 95% | 5.5 |
| $CHCl_3$-Methanol (azeotrope) | 80 | 16.8 | 25% | 4.2 |
| Hexane-Ethanol (azeotrope) | — | 6.2 | 80% | 5.0 |

(1) based on dried tobacco weight
(2) based on weight of chloroform solubles
(3) based on $CHCl_3$ solubility The present invention, in utilizing a solvolysis system for elements of the tobacco plant permits the reduction of lipids in tobacco with substantial retention of the residual structural integrity of the tobacco elements. The consequence of this phenomenon is that density is reduced, and filling power increased for processed tobacco material used directly in the formulation of smoking composition, with attendant benefits known to those skilled in the art. Further, and importantly, the selective use of the present extractive system removes a substantially high level of the lipids present in tobacco.

Significance to organoleptic properties of the resultant smoking article is apparent.

In the foregoing examples, the lipid content of the tobacco is determined by exhaustive extraction with hexane-ethanol (80:20 vol/vol) in a Soxhlet apparatus unless otherwise indicated.

I claim:

1. A process of preparing smoking compositions to remove lipid therefrom comprising contacting said tobacco with alkaline water and a water-soluble organic solvent, the total amount of water present being at least 15 percent by volume and thereafter forming the extracted tobacco into a smoking composition without restoring lipids thereto.

2. A process according to claim 1 wherein said solvent is a lower alkanol.

3. A process according to claim 2 wherein said alkanol is isopropanol.

4. A process according to claim 2 wherein said alkanol is ethanol.

5. A process according to claim 2 wherein said alkanol contains up to 50 vol-% water.

6. A process according to claim 5 wherein the ratio of alkanol to water is 80:20.

7. A process according to claim 2, wherein said water is at a pH of from about 9 to about 11.

8. A process according to claim 1 wherein said tobacco is in highly comminuted form.

9. A process according to claim 1, wherein the tobacco is contacted with said solvent while wet with water.

10. A process according to claim 9 wherein each step comprises a plurality of washings.

11. A smoking composition comprising tobacco treated in accordance with claim 1.

* * * * *